US011885191B2

(12) United States Patent
Craig

(10) Patent No.: US 11,885,191 B2
(45) Date of Patent: Jan. 30, 2024

(54) PATCH FOR JOINING DOWNHOLE ENDS OF PIPES

(71) Applicant: Wellbore Integrity Solutions LLC, Houston, TX (US)

(72) Inventor: Daniel T. Craig, Katy, TX (US)

( * ) Notice: Subject to any disclaimer, the term of this patent is extended or adjusted under 35 U.S.C. 154(b) by 0 days.

(21) Appl. No.: 17/169,372

(22) Filed: Feb. 5, 2021

(65) Prior Publication Data

US 2021/0246751 A1 Aug. 12, 2021

Related U.S. Application Data

(60) Provisional application No. 62/972,626, filed on Feb. 10, 2020.

(51) Int. Cl.

| | |
|---|---|
| ***E21B 31/00*** | (2006.01) |
| ***E21B 31/12*** | (2006.01) |
| ***E21B 36/00*** | (2006.01) |
| ***E21B 17/04*** | (2006.01) |
| ***E21B 33/10*** | (2006.01) |

(52) U.S. Cl.

CPC ..... *E21B 31/007* (2013.01); *E21B 17/04* (2013.01); *E21B 31/12* (2013.01); *E21B 33/10* (2013.01); *E21B 36/00* (2013.01)

(58) Field of Classification Search

CPC ..... E21B 31/007; E21B 17/04; E21B 31/12; E21B 33/10; E21B 36/00; E21B 29/10; E21B 31/00; E21B 31/20; E21B 17/03; E21B 43/10; E21B 31/18

See application file for complete search history.

(56) References Cited

U.S. PATENT DOCUMENTS

| | | | | |
|---|---|---|---|---|
| 2,659,440 | A | 11/1953 | Osmun | |
| 2,789,004 | A * | 4/1957 | Foster | E21B 31/007 164/DIG. 12 |
| 4,660,863 | A | 4/1987 | Bailey | |
| 5,070,788 | A * | 12/1991 | Carisella | F42D 1/04 102/222 |
| 7,290,609 | B2 | 11/2007 | Wardlaw | |
| 10,309,187 | B2 * | 6/2019 | Carragher | E21B 41/00 |
| 11,753,897 | B2 * | 9/2023 | Carragher | E21B 36/00 166/302 |

(Continued)

FOREIGN PATENT DOCUMENTS

| | | |
|---|---|---|
| GB | 2312906 A | 11/1997 |
| GB | 2594776 B | 11/2021 |
| WO | 02099247 A1 | 12/2002 |

OTHER PUBLICATIONS

Francesco Baccarin1, Henrik Büsing2, Stefan Buske3, Andrea Dini4, Adele Manzella4, Wolfgang Rabbel5, and the Descramble Science and Technology Team, "Understanding supercritical resources in continental crust", Jun. 2019, EGC 2019, pp. 1-10. (Year: 2019).*

(Continued)

*Primary Examiner* — Jonathan Malikasim

(74) *Attorney, Agent, or Firm* — Marc A. Hubbard; Hubbard Law, PLLC

(57) ABSTRACT

A downhole tool for joining a string of pipe to a tubular already downhole with a seal element made of metal or metal alloy with a melting point lower than the melting point of the tool and tubular but higher than the temperature of expected downhole operating conditions.

25 Claims, 1 Drawing Sheet

(56) References Cited

U.S. PATENT DOCUMENTS

| | | | | |
|---|---|---|---|---|
| 2010/0258311 | A1* | 10/2010 | Craig | E21B 29/10 166/242.6 |
| 2016/0340992 | A1 | 11/2016 | Sanchez | |
| 2018/0313193 | A1 | 11/2018 | Gibb | |

OTHER PUBLICATIONS

Combined Search and Examination Report under Sections 17 and 18(3) for App No. GB2101739.7, dated Oct. 4, 2021, 11 pages.
Examination Report under Section 18(3), UK Intellectual Property Office, Application No. GB2101739.7, dated Jul. 25, 2022.
Reply to Examination Report of Oct. 4, 2021 in UK Patent Application No. 2101739.7, filed Apr. 11, 2022.
Reply to Examination Report dated Jul. 25, 2022, in UK Patent Application No. 2101739.7, filed Sep. 26, 2022.
Logan Oil Tools High-Pressure-Type-L-Casing-Patch, Manual F635, Nov. 2013.
Logan Oil Tools, High Pressure Type L Packer Type Casing Patches, 2013.
National Oilwell Varco High Pressure Type L Packer Type Casing Patches, 2006.
BISN Wel-lok M2M Sealing Solutions, 2019.
Logan Oil Tools Type a Packer Type Casing Patches, 2019.
Logan Oil Tools Lead Seal Casing Patches 2019.
Pioneer Oil Tools Limited, Pioneer Lead Seal Cementing Casing Patches LCP Series, 1999.

* cited by examiner

PATCH FOR JOINING DOWNHOLE ENDS OF PIPES

RELATED APPLICATION

This application claims the benefit of U.S. Provisional Application No. 62/972,626 filed Feb. 10, 2020, the entirety of which is incorporated herein by reference for all purposes.

FIELD OF INVENTION

The present invention relates to downhole tools and methods for attaching in a wellbore two ends of pipe, casing, or tubing.

BACKGROUND OF INVENTION

Many types of tubing are used when drilling, completing and working-over oil and gas wells. Examples includes drill strings, production tubing, and casing. Most wellbores drilled for oil and gas production are cased with large diameter pipe made from steel. Casing is usually comprised of a string of pipe joints—lengths of pipe—joined by threaded connections. Casing a wellbore provides a number of benefits, such as preventing or controlling migration of fluids and gases between the wellbore and the formation; improving the stability of the walls of the wellbore; isolating sections of the wellbore due to pressure concerns; reducing the risk of the fluids and gases flowing through wellbore causing damage to the formation; and providing an internal bore with consistent geometry and wall smoothness to improve fluid flows and facilitate use of downhole tools. Casing may be supported by cement that fills the void between the exterior wall of the casing and the interior wall of the borehole, which is called the annulus. Cementing provides additional support for casing and assists in supporting the casing in the borehole and in preventing the casing from shifting with the borehole. Casing may also be supported within a wellbore by casing hangers.

Damaged casing may cause a blowout, loss of production, contamination of the formation surrounding the borehole, contamination of production products, and contamination of other downhole fluids such as mud. Any number of situations may cause damage, such as physical wear of the interior casing caused by downhole tools or by intervention procedures in which drill string, production, or intervention components come into contact with the casing; deterioration of the casing caused by chemical interactions between fluids or gases inside or outside of the casing; and shifts in the formation causing the wall of the borehole to impact the casing.

In addition, a casing may become kinked or stuck within a wellbore, making it difficult or impossible for it to be lowered further into or pulled out of wellbore. This may be caused, for example, by shifts in the formation surrounding the borehole, variations in the contour of the borehole wall, kinks or dog legs in the length of the borehole, or intentional changes of direction of the borehole. A kink or bend in the casing may also impede passage of drill strings and other downhole tools through the casing or result in the tools causing wear or damage to the casing, resulting in leakage through the casing and/or the tools being damaged.

There are several ways of repairing casing in place. Repair may, however, require instead replacing a portion of the casing. This is done by cutting the casing to allow an upper portion of the casing string to be pulled from the wellbore and then replacing it with a new casing that is lowered into the wellbore and joined to the end of the portion of the casing remaining in the hole. The remaining casing left in place in the wellbore is referred to as a "fish," In oilfield industry jargon, a fish is any piece of equipment that falls into or is left in the wellbore that cannot be retrieved because it is no longer attached to a string of tubing that can be pulled from the surface.

To connect the end of the casing string to the fish—the end of the portion of the old casing string remaining in the hole—a downhole tool called a "casing patch" is attached to the end of the replacement string of casing prior to it being lowered into the hole. Casing patches are capable of joining the ends of any type of tubing or pipe, not just casing pipe. The description below will reference downhole tools capable of joining then ends of two strings of pipe downhole as "casing patches," given that is a primary use for such tools. However, referencing them as "casing patches" is not intended to limit their use to casing pipe. Casing patches can be adapted for joining downhole the ends of other types of pipe or tubulars.

A casing patch is typically comprised of a fishing tool and a seal. The fishing tool attaches or latches to the casing to establish a mechanical connection with the casing pipe. The seal fills the void between the casing patch and the casing pipe. A casing patch will also typically have some sort of guide below the tool to help find and guide the end of the pipe into the patch as the patch is being lowered. The casing patch may be part of a bottom hole assembly (BHA) that includes other types of components commonly used with fishing tools and/or BHAs in general, non-limiting examples of which include "jars," "washovers," and mills. A casing patch may also comprise part of a bottom hole assembly (BHA) that includes other tools and various diagnostic components. For example, although not typically required or used with casing patches, a mill may also be placed between the fishing tool and a guide for the purpose of cleaning the ends and/or exterior of the fish to facilitate insertion of the fish into the grapple. Casing patches will also typically have a top sub for connecting the casing patch to the string of casing pipe, to which the fish is being joined by the casing patch. In addition, casing patches may have an additional extension sub below the top sub to provide additional working length of the casing patch, when necessary.

There are two fundamental types of casing patches: an overshot and a spear. A casing patch with a grapple that fits over the outer diameter of a fish is an external catch or overshot type. A casing patch that attaches to the inner diameter (ID) of the fish by inserting at least part of the casing patch into the fish is referred to as an internal catch tool or spear type. A casing patch with an external catch typically seals against the OD of the fish. A casing patch with an internal catch usually seals against ID of the fish but may instead seal on the OD of the fish. The most common types of grapples used in external catches are basket grapples and spiral grapples. Both basket and spiral grapples are placed into a "bowl," which is a portion of the casing patch with a large enough diameter for the fish to enter without the grapple engaging. They are, in most cases, engaged by pulling upwardly on the casing patch after the casing patch has been lowered onto the fish. The upward pulling movement results in an expansion strain being placed on the bowl and the grapple, which in turns causes the grapple to exert a compression strain on the fish, thus securing the grapple to the fish. Spiral grapples are formed with a tapered exterior to conform with the helically tapered section of the bowl. The interior of a spiral grapple is "wickered" for engagement with the fish. A basket grapple, on the other hand, is formed by an expandable cylinder with a tapered exterior to conform to the helically tapered section of the bowl. The interior of a bowl grapple is wickered to allow for engagement with the fish. Internal catches typically attach to the interior wall of the fish using slips. Casing patches are usually intended to be permanent, but they may use instead releasable grapples or slips.

Seals in casing patches are intended to prevent fluid leakage from the joint that is formed by the overlap of casing patch and end of the casing pipe that is already in the hole. Sealing elements may be located above, below, or both above and below the means for attaching to the fish, for example a grapple or slips. Multiple types of seals, or means for sealing, are known in the art including rubber or elastomer-based seals, metal band seals, and lead seals. A casing patch may include multiple types of seals, such a rubber and metal, and may include a primary seal and a backup seal. Most seals are designed to have an interference fit between the casing and casing patch that results in the seal being compressed between the casing patch and casing. However, it is possible for seals to be expanded to fit the volume between the casing and the patch by compressing them axially using an actuator. Lead seals are designed to deform to accommodate the end of the casing pipe. The diameter of the lead seal for an overshot type of casing patch is typically tapered, with a diameter at a lower or downhole end of the seal being larger than the diameter of the upper end. As the end of the casing pipe already in the hole is inserted, the seal deforms to fit the outer diameter of the casing.

SUMMARY

Traditional seals used in casing patches often do not satisfactorily impede or prevent gas from migrating through the joint between the patch and the fish or other downhole tubular, especially when the gas is under high pressure. Representative examples of a downhole tool for joining two lengths of pipe downhole and methods of joining two lengths of pipe downhole disclosed below involve a seal that is capable of creating a seal between the downhole tool and a fish that reduces the risk of undesirable gas leakages between the tool and the fish. The downhole tool connects two lengths of pipe downhole and uses a eutectic or low melting point metal to create a seal between the tool and a pipe (or other type of pipe) already in the hole. A representative example of the tool is a casing patch, but the tool may also be used to join a length of any type of pipe to another length of pipe or tubular downhole and seal the joint.

The downhole tool is connected to a length of pipe using standard connection techniques, such as a threaded connection, that creates a seal that is able to withstand expected fluid pressures and resist migration of fluids through the joint. It is lowered downhole. Once a lower end of the tool overlaps with and is mechanically joined to the pipe that is already in the wellbore, a seal comprised of eutectic metal or alloy is heated to a predetermined temperature or range of temperatures to cause the metal to melt and flow into any voids between the tool and the pipe casing within the joint. The heat is supplied by a heater that is lowered with the tool or is lowered on a wireline or by other means. The heater is placed at a point near enough to the seal so that, when activated, it is capable of heating the seal to cause the eutectic metal or alloy to melt. The heater is then removed or milled out. Once solidified, the eutectic metal or alloy forms a seal between the tool and the end of the casing pipe. Because the melting metal or alloy is able to flow, the resulting seal is more likely to completely fill the void between the surfaces of the tool and the pipe, reducing the potential for gas leaks, especially under high pressure conditions.

In one representative embodiment, the downhole tool comprises a seal made of a low melting point metal comprised of or metal alloy that melts at temperatures that would not cause damage to the other components of the tool or to the pipe to which it is joined, but otherwise has a high enough melting point that it will not melt when subjected to expected downhole operating temperatures.

In another representative embodiment, the downhole tool comprises at least one other seal that does not melt. The second seal helps to contain the flow of the low melting point metal or alloy. In yet another embodiment, the at least one other seal may also act as a pressure seal prior to the melting and/or act as backup seal in the event the seal formed by the low melting point alloy fails.

Described below are non-limiting examples of the downhole tool in the form of a casing patch. The casing patch is intended to be representative of a downhole tool capable of joining together the ends of two pipes or other tubulars downhole.

DETAILED DESCRIPTION

In the following description of representative embodiments and examples of the claimed subject matter, like numbers refer to like parts. References to "eutectic metal" or "low melting point metal" are intended to include metal alloys that are eutectic unless the context indicates differently. An eutectic alloy is a mixture of metals that has a single melting point that is lower than the melting point of any of the constituent metal components of the alloy.

Figure 1:
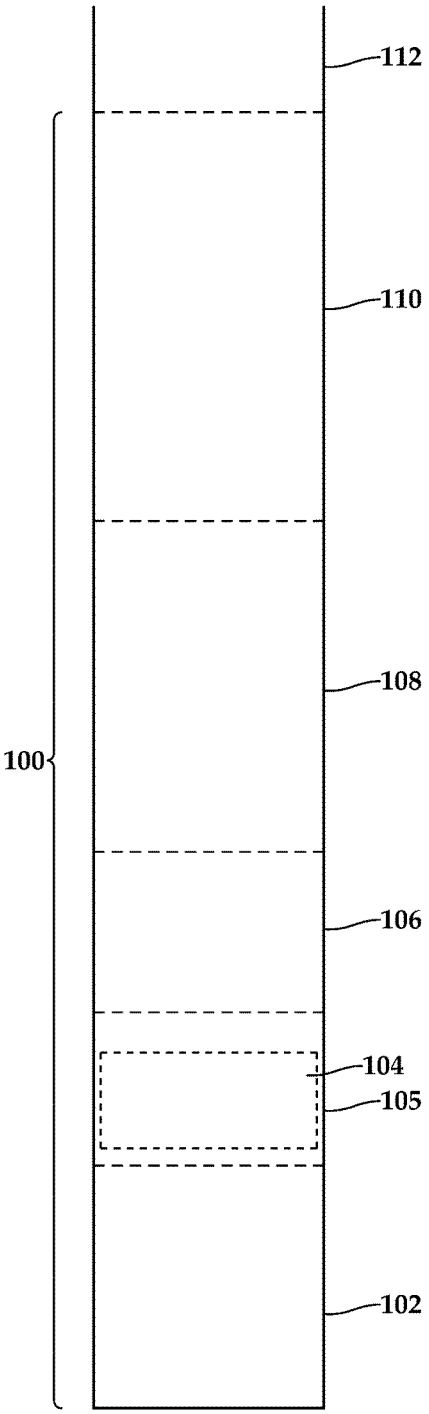
FIG. 1 is a schematic representation of an embodiment of a casing patch.

FIG. 1 is a generalization or schematic illustration of a simplified, representative embodiment of an overshot type of casing patch 100 with an external catch and a seal formed at least in part by a eutectic alloy. However, in alternative embodiments, the seals, as described below, may be adapted to be used in casing patches that seal against the inner diameter (ID) of a fish and casing patches with an internal catch and either an internal (against ID of fish) or external (against OD of fish) seal. Furthermore, although most often used for patching casing, casing patch 100 and the variants and alternatives described here can be used to join downhole pipes or other tubulars used for purposes other than to case a hole. Although casing patch 100 is shown in a vertical orientation, it may also be run into a horizontal wellbore. Casing patch 100 has multiple sections or components assembled into an assembly that is lowered into the hole on the end of a string 112 of casing pipe or other type of pipe. The components typically found in a casing patch are represented in the illustrated example: a guide 102, grapple 104, bowl 105, seal 106, and a connection to the string 112, which in this example includes an extension sub 108 and top sub 110. The casing patch connects string 112 to a free end of a casing or other type of pipe string (not shown) or other type of tubular already in the wellbore. The string 112 is also used to lower the casing patch into the wellbore The guide 102 assists with locating and capturing the upper end of a casing string (not shown) already in the hole, referred to as a "fish," and aligning it with the casing patch. There many types of guides known in the art. Because the casing patch 100 is an external catch type of casing patch, guide 102 is configured or adapted to move the fish into an opening in the bottom of the casing patch as it is lowered. If casing patch 100 uses an internal catch, the structure of the guide 102 locates an opening in the end of the fish and guides the casing patch into the center bore of the fish.

Located above guide 102 is a grapple 104. There could be other components located between the guide and grapple that are not shown. FIG. 1 and the remaining figures are not intended to exclude the possibility of additional components. The grapple 104 comprises a means for mechanically latching the casing patch to the fish. Non-limiting examples of grapples include basket grapples and spiral grapples. Other types of fishing tools or catches—any tool capable of latching onto the fish—or other means for mechanically latching or attaching to the fish by overlapping the downhole tool with the fish could be substituted. Non-limiting examples of such means include grapples, slips, and combinations of them. Furthermore, more than one such mechanical means of the same or different types could be adapted and substituted for the grapple 104, depending on whether the downhole tool will take the form of an overshot or a spear and/or other considerations, including grapples, slips, and other types of internal or external catches suitable for connecting tubulars using an overlapping joint.

The seal 106 is comprised of one or more elements, at least one of which will form a seal that impedes or prevents movement fluid through one or more gaps between the casing patch 100 and the fish where the two overlap. The gap will be generally annular in shape but may vary in width. Multiple seals, each with one or more sealing elements, may be used. Although shown above grapple 104, seal 106 could be located below the grapple. If multiple seals are used, they may be located on opposite sides of the grapple.

In one embodiment, at least one seal is comprised of one or more elements made from a metal having a melting point that is lower than the temperature at which other components of the casing patch melt or would be damaged if subjected to a temperature hot enough and long enough to melt the element. This sealing element will be referred to as a melting metal seal and it is comprised of one or more melting metal sealing elements. In another embodiment, seal 106 is further comprised of one or more elements made of rubber, elastomer, lead, or metal that do not melt when the melting metal seal is melted. The melting metal seal is solid when the casing patch is lowered and connected with the fish. Once the casing patch is mechanically connected with the fish, the melting metal seal is melted using a heating element that is lowered with the casing patch or subsequently lowered on, for example, a wire line. Heating the melting metal seal to cause it to melt results in the metal flowing into gaps or openings between adjacent surfaces of the fish and casing patch. After the heat is removed, the metal cools and forms a seal in the gaps and opening between the casing patch and fish that will impede the flow of liquids and gases between the inside of the casing or other type of pipe and the wellbore.

The melting metal of the sealing element for seal 106 is comprised of one or more elemental metals such as aluminum, lead, or bismuth. The melting metal has a lower melting point as compared to the metals from which the pipe to which the casing patch is connected and the other elements of the casing patch.

In one example, the melting metal of a sealing element is an alloy of two or more elemental metals. In yet another example, the melting metal is a eutectic alloy. In another example, the melting metal for the sealing element is an alloy of bismuth and one or more other elemental metals. In another example, the melting metal sealing element is a eutectic alloy of bismuth and one or more elemental metals.

Bismuth is an example of metal having a relatively low melting point. It melts at 271.4° C. Certain bismuth alloys are known to melt at even lower temperature. In addition, certain bismuth alloys are eutectic alloys. Eutectic alloys are mixtures of metals that have one melting point, which is below the melting point of the alloy's constituent metals. Bismuth based eutectic alloys may be formed that shrink upon melting and expand upon cooling, i.e. a sample of the alloy has a higher volume when solid than the same sample has when in liquid form. Bismuth based eutectic alloys may, in addition to bismuth, contain cadmium, lead, tin, and/or indium. By varying the amount by weight of non-bismuth components of the alloy, a bismuth-based alloy's eutectic melting point can be increased or decreased. Known bismuth based eutectic alloys may have a melting points ranging from at or near the melting point of bismuth, which is 271.4° C., to a temperature at or near 50° C.

A eutectic alloy, particularly, for example, one that is bismuth-based, can be formulated to have a melting point above downhole operating temperatures that are expected to be encountered by the casing—for example, the expected temperatures of the fluids in the wellbore. The alloy would therefore remain solid in conditions expected to be encountered during drilling, completion, intervention, and/or production activities, but low enough for the melting metal seal to be melted without damaging surrounding components, such as the tubulars making up the casing or other type of pipe that is being joined by the casing patch and other components of the casing patch. Furthermore, use of a eutectic alloy with a larger solid volume than a liquid volume may, when properly employed, increase the effectiveness of the seal. While liquid, the alloy will flow into and fill a gap or other area between opposing surfaces of the casing patch and fish that is to be sealed. Upon cooling, the alloy expands to ensure good contact with and a tight fit against the opposing surfaces of the casing patch and the overlapping end of the fish.

In one embodiment, the melting metal used for the sealing element has a single melting point and does not exhibit a slush or gel phase between its solid and liquid phases.

In embodiment, the melting metal sealing element has a melting point that is lower than the temperature than the annealing temperature of the pipe to which the casing patch is being connected.

In one example, the melting point of melting metal for the sealing element of seal 106 is in the range of 700° C. to 100° C. In another example, the melting point of the melting metal sealing element is in the range of 350° C. to 100° C. In yet another example, the melting point of the melting metal sealing element is in the range of 275° C. to 100° C.

If a eutectic alloy of bismuth and one or more elemental metals is used as the metal sealing element, the melting point of the melting metal sealing element is in the range of 275° C. to 100° C. and more preferably in the range of 200° C. to 150° C. Optionally, but preferably, the melting metal increases in volume when it changes from its liquid form to its solid form and decreases in volume when it changes from its solid form to its liquid form. If the melting metal is an alloy of bismuth and one or more elemental metals, it is preferred, but not required, that the alloy contains at least 25% bismuth by weight, more preferably at least 35% by weight, and even more preferably at least 45% by weight.

In one example, the melting metal sealing element may be formed from a bismuth eutectic alloy that melts in the range of 275° C. to 100° C., and the other metal sealing element may be solid lead. The seal of the melting metal sealing element is formed by heating the melting metal sealing element in the range of 275° C. to 100° C. until it melts, allowing the melting metal sealing element to flow into the area to be sealed, and allowing the melting metal sealing element to cool so that it forms a seal.

A representative example of a method of using the casing patch 100 to connect a string of pipe to a tubular element, the "fish," comprises making up an assembly that includes the casing patch 100 and lowering the assembly on the end of a string 112 of casing pipe or other type of pipe that will be connected to the fish using the casing patch. The fish may have been previously prepared for connecting with the casing patch. Alternately, the assembly may include tools (not shown or indicated in the figures) that are used to prepare the fish for connection with the casing patch. The fish is then caught using guide 102 or other means. The casing patch is then lowered further so that it is aligned with the fish to form a mechanical connection and seal. The mechanical connection is made by setting grapple 104 or other type of connector. The method of setting depends on the type of connector. Examples of the types of actions for setting the connection include pushing up or down on the string, rotating the string, or actuating an electric, hydraulic or other type of setting tool. The method of using the casing patch is not limited to particular means or manners of mechanically connecting the casing patch and the fish.

Once connected, the section of the casing patch comprising seal 106 and the fish should overlap. One or more acts are taken to set or to complete formation of the seal between the casing patch and the fish. Seal 106 may have more than one type of sealing element but comprises at least one melting metal seal element. Furthermore, as previously mentioned, the casing patch may include more than one section of sealing elements, at least one of which overlaps the fish once the mechanical connection is set.

The act of setting or completing the sealing comprises melting the melting metal sealing element by applying heat to it. Where the melting metal flows, how much flows, and how quickly it flows is controlled using baffles or barriers that constrain or resist, block, or trap or contain it within the seal 106. In one embodiment, the flow of the melting metal is at least partially directed or contained by a seal that is comprised of at least one sealing element (not shown in FIG. 1) other than a melting metal sealing element that cooperates with the fish to act as a barrier to the flow by impeding migration along the axis of the casing patch beyond the sealing element. The seal may include more than one barrier to prevent flow of melting metal. For example, barriers may prevent flow or migration parallel to the center axis of the casing patch or, if desired, around the center axis. Non-limiting, representative examples of structural elements for forming an axial barrier to constrain movement of melting metal include sealing elements, such as packers with metal and/or elastomeric packing elements, lead seals, and compression fit springs. One or more these sealing elements may be sacrificed during the melting of the metal and subsequent solidification. The sealing elements acting as barriers may also function as secondary or back-up seals if not sacrificed when completing formation of the melting metal seal.

After a predetermined amount of time to allow the melting metal to pool, heating is discontinued and the melting metal is allowed to cool, if possible, without disturbing it. The ambient conditions should allow it to cool to the point of solidification, but cooling fluid could be circulated past the casing patch to facilitate cooling or reduce cooling time.

If sealing elements of seal 106 or other seal included with the casing patch requires setting, such as by compressing it or inflating it to cause it to expand radially, this may be done before, during or after the melting meal sealing element is melting. If the sealing element comprises a barrier or trap for the melting metal sealing element, it should be set prior to melting the melting metal sealing element.

Upon cooling below its melting point, the melting metal sealing element hardens. In one embodiment, the resulting seal surrounds and extends radially from the casing patch to the fish. In the embodiment in which the melting metal sealing element is made from an alloy that expands in volume upon cooling, the effectiveness of the seal is increased by the expansion of the alloy as it changes from liquid form to solid form, thus exerting additional sealing pressure against the components to be sealed. In another embodiment, the resulting seal fills gaps or other openings that may otherwise exist between another type of sealing element in the seal and where that sealing element engages the casing patch and/or fish.

If there is more than one seal with a melting metal sealing, the melting metal sealing elements may be "set" sequentially or at the same time.

Figure 2:
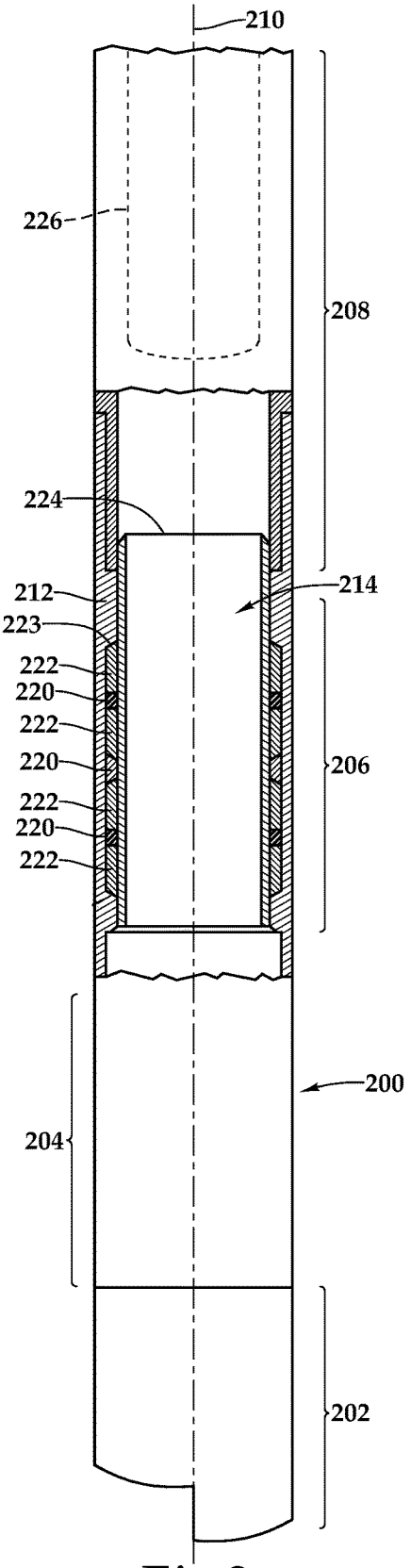
FIG. 2 illustrates a simplified, non-limiting, representative example of a casing patch that is partially sectioned along its center line at its seal.

Referring now to FIG. 2, casing patch 200 is intended as a simplified, non-limiting, representative example of a casing patch. It is comprised of an assembly of tubular elements that include a guide 202, grapple or other type of mechanical connector 204 for connecting the casing patch to a fish, a seal 206, and a sub 208. The section with the seal 206 is taken along the center axis 210. Seal 206 is comprised of a tubular housing 212 that defines a center bore 214. The center bore extends throughout the length of the casing patch 200, in which a fish (not shown) is received, with the end of the fish the seal 206, into the sub 208. As with the casing patch 100, casing patch 200 may include additional elements that are not shown.

In this example, seal 206 has a plurality of sealing elements. They include a plurality of melting metal sealing element and a plurality of barriers or traps 222 for the melting metal sealing element. Each barrier 222 is comprised of a sealing element that may also, unless sacrificed during the melting and solidification of the melting metal sealing elements, act as back up or secondary seal. Non-limiting examples of sealing elements that may comprise a barrier 222 include one or more of the following: packers, which may comprise one or more elastomeric packing elements, metal packing elements, or a combination of metal and elastomeric packing elements; an inflatable packer or packing element; a lead seal; and a metal compression fit spring. Other types of sealing elements could also be used as barrier 222.

The sealing elements comprising the barriers 222 and the melting metal sealing elements 220 are protected and held in place by a sleeve-shaped seal protector 224 that remains in place as the casing patch is lowered, until the end of a fish engages and pushes it upwardly into the sub 208. In this example, each melting metal sealing element 220 is sandwiched between two barriers 222. The barriers prevent a melting metal sealing element 220, when in a liquid state from flowing in an axial direction (a direction generally parallel to the center axis 210) beyond the barriers. This allows for the casing patch not to be vertical while still ensuring that liquid metal will not flow into a position that does not form a proper seal once it solidifies. Because the melting metal sealing elements 220 and the sealing elements comprising the barriers 222 are stacked and held in place by shoulders formed on an inner surface of the housing 212 of the casing patch. The barriers 222 thus may optionally also assist with maintaining the position of the melting metal sealing element before and/or after solidification.

Each of the sealing elements comprising the barriers 222 in this example have a ring shape and create a seal in an annulus formed between the inner surface of the housing 212 of the casing patch and an outer surface of the fish (not shown). Each of the sealing elements are, in this example, deformable or compressible. Each has an inner diameter slightly smaller than the expected outer diameter of the fish to so that it is slightly compressed and deformed by the fish, thereby creating a friction fit that is sufficient to act as a barrier to trap liquid metal when the melting metal sealing element 220 is heated.

The sealing elements are, in one embodiment, not intended to melt. However, unless they are intended to function also as backups, it is possible to allow for them to be damaged or otherwise sacrificed during the heating and solidification process. For example, if a lead seal is used as a barrier 222, the melting point of lead is 327.5° C., thus, it is possible to melt a melting metal sealing element 220 made from a eutectic alloy without melting the lead seal.

Each of the melting metal sealing elements 220 would be expected to solidify into a ring shape due to the barriers 222 placed on opposite sides. However, it has the potential to conform better to any irregularities in the surface of a fish and the casing patch as compared with other types of preformed sealing elements that are deformed but not melted. Though other types of sealing elements can deform, they tend not to be able to conform as well to the surfaces against which they seal, especially if those surfaces are irregular due to damage or other reason, or irregularities in a surface are too small for the conventional seal to conform to. The melting metal sealing element 220, once properly heated and solidified, is capable of providing a better quality seal against migration of gases, especially those under high pressure, which might otherwise infiltrate small gaps between a conventional sealing element and a surface against which it seals and exert sufficient pressure to deform and bypass the sealing element or otherwise pass through the sealing element.

The shape, number of; and position of the melting metal sealing elements 220, and the arrangement of barriers 222, including their number, geometries, orientations, and positions relative to each other and to a melting metal sealing element 220, as shown is intended to be representative and non-limiting, as they may vary based on the particular application. Furthermore, the barriers 222 could be used to form a sealing element with a shape other than a ring, or with more complex geometries.

In addition to forming a seal, or as an alternative to using the melting metal to form a primary or secondary sealing element following solidification, the liquified metal could be used to augment or improve the quality of the seal of other types of sealing elements in the casing patch by allowing it to flow around another sealing element and into gaps or other openings that may exist between the sealing element and the surfaces against which it is intended to seal. The melting metal sealing element 220 thus supplements or may be used to form a supplemental seal for another sealing element.

To melt a melting metal sealing element 220, any suitable heater or source of heat is placed in close enough proximity to the melting metal sealing element 220 for period of time sufficient to elevate the temperate of the melting metal sealing element 220 to above its melting point without damaging the other components in the casing patch (unless the element is intended to be or can be sacrificed.) The heater may comprise, for example, one or more resistive heating elements with electric current supplied by a wireline from the surface, chemicals for creating an exothermic chemical reaction, mud motor with an output driving a frictional load that generates heat, or a source of radiation (such a microwaves), in each case creating heat that is transferred to the melting metal sealing element 220. The heater may, alternatively or in addition, be comprised of hot fluids being circulated close to the seal, such as either by pumping it down the string or through a retrievable pipe connected with a heat exchanger placed within the center opening of the casing patch next to seals or, possibly, incorporated in the tubular housing of the casing patch.

In one embodiment, the heater is a separate apparatus that is lowered with the casing patch and then withdrawn or removed by milling it. For example, as shown in FIG. 2, a heating element 226 may be placed in a sub 208 above the seal 206 but still in its proximity and heat the melting metal seals 220 through transfer of the heat by the casing patch and/or fluid within the center bore 214. The heater may, alternatively, be lowered from the sub 208 into the end of the fish so that it is closer to the seal 206 after the casing patch is connected to the fish.

Alternatively, the heater may be lowered from the surface and positioned with the casing patch, near the seal, after the casing patch is connected to the fish, such as on a wireline or on the end of coiled tubing. Optionally, the heater could be further assembled with sensors or other instruments for monitoring the heating and cooling of the melting metal sealing element 220. The assembly may, optionally, further include instruments for testing the seal after it is formed. It may even include a plug, if necessary, for plugging the string below the casing patch to create pressure for testing.

In still other embodiments, the heater may be incorporated as a section of the assembly comprising the casing patch, or incorporated directly into a component of the assembly, such as housing 212 of the seal 206. For example, a heater placed above the seal 206 could heat the housing 212 of the seal 206 by conduction, which would then heat and melt the melting metal sealing element.

Alternatively, heated fluid may be pump through any available downhole passage such as the inside casing string 112 or other type of tubing string on which the casing patch 100 is suspended, through other tubing located inside the casing string 112, or through the annulus between the wellbore and casing 112 and casing patch 100.

While, the above described embodiments are described in the context of a casing patch, the invention is not intended to be limited to casing patches. One skilled in the art can appreciate that the invention may also be used to repair, replace, or seal any downhole tubing, such as production tubing.

What is claimed is:

1. A downhole tool for joining a string of pipe to which the downhole tool is attached to a downhole tubular in a wellbore, the downhole tool comprising:

a connector disposed on an upper end of the downhole tool capable of joining the upper end of the downhole tool to the string of pipe;

a catch adapted to join a lower end of the downhole tool to an upper end of the downhole tubular by lowering the downhole tool to overlap the lower end of the downhole tool with the upper end of the downhole tubular; and at least one seal capable of creating a seal between the lower end of the downhole tool and the downhole tubular where they overlap;

wherein the downhole tool defines a hollow passageway capable of communicating fluid between the string of pipe and the downhole tubular once the downhole tool is joined to the string of pipe and the downhole tubular; and wherein the seal comprises:

a housing; and a plurality of sealing elements, the plurality of sealing elements comprising:

one or more melting metal sealing elements made of a eutectic metal alloy with a melting point lower than an annealing temperature of the tubular; and one or more sealing elements made of rubber, non-rubber elastomer, or a non-eutectic metal or metal alloy configured to act as barrier to impede migration of a flow of the eutectic metal or metal alloy when melted by a heater within the vicinity of the one or more melting metal sealing elements.

2. The downhole tool of claim 1 wherein the eutectic metal or metal alloy comprises bismuth and at least one other elemental metal.

3. The downhole tool of claim 1 wherein the melting point of the eutectic metal or metal alloy is between 100° C. and 250° C.

4. The downhole tool of claim 1 wherein the melting point of the eutectic metal alloy is between 100° C. and 327.5° C.

5. The downhole tool of claim 1 wherein the eutectic metal alloy increases in volume when the metal or metal alloy changes from liquid form to solid form.

6. The downhole tool of claim 1, wherein the one or more sealing elements made of rubber, non-rubber elastomer, or a non-eutectic metal or metal alloy has a higher melting point than the melting point of the one or more sealing elements made of a eutectic metal or metal alloy.

7. The downhole tool of claim 1 wherein the string of pipe and the downhole tubular are casing pipes.

8. The downhole tool of claim 1 wherein the catch comprises a fishing tool.

9. The downhole tool of claim 8 wherein the fishing tool comprises a grapple or slips.

10. The downhole tool of claim 1 wherein the catch creates a mechanical joint that resists relative axial movement of the downhole tool with respect to the downhole tubular in at least one direction.

11. The downhole tool of claim 10 wherein the catch comprises one or more of a grapple and a slip.

12. The downhole tool of claim 1, wherein at least one of the one or more sealing elements made of rubber, non-rubber elastomer, or non-eutectic metal or metal alloy is sacrificed during melting of the at least one or more melting metal sealing elements.

13. A method of connecting a string of pipe to an end of a downhole tubular in a wellbore, the method comprising:

lowering a downhole tool into the wellbore on the end of the string of pipe, the downhole tool comprising a catch and a seal, the seal comprising a housing and a plurality of sealing elements;

overlapping a lower end of the downhole tool and an upper end of the downhole tubular and setting the catch to form a connection between the lower end of the downhole tool and the upper end of the downhole tubular where they overlap;

melting the melting metal sealing elements by heating the melting metal sealing elements;

stopping heating of the metal sealing elements after they melt to allow the melting metal to solidify to form at least a partial seal between the downhole tool and the end of the downhole tubular;

wherein the plurality of sealing elements comprises:

one or more melting metal sealing elements made of a eutectic metal alloy with a melting point lower than an annealing temperature of the tubular, and one or more sealing elements made at least in part from of rubber, non-rubber elastomer, or non-eutectic metal or metal alloy, which are configured to act as barrier to impede migration of a flow along the casing patch of the eutectic metal or metal alloy when melted by a heater within the vicinity of the one or more melting metal sealing elements.

14. The method of claim 13 wherein the melting metal sealing elements are made from an alloy of bismuth and at least one other elemental metal.

15. The method of claim 13 wherein the melting point of the eutectic metal alloy is between 100° C. and 250° C.

16. The method of claim 13 wherein the melting point of the eutectic metal alloy is between 100° C. and 327.5° C.

17. The method of claim 13 wherein the melting point of the eutectic metal alloy increases in volume when the metal or metal alloy changes from liquid form to solid form.

18. The method of claim 13 wherein the one or more sealing elements which are made of rubber, non-rubber elastomer, or a non-eutectic metal or metal alloy have a higher melting point than the melting point of the eutectic metal alloy.

19. The downhole tool of claim 13 wherein the downhole tubular is casing pipe.

20. The method of claim 13 wherein heating the melting metal sealing elements comprises applying heat from a heater lowered into the wellbore close enough to the melting metal sealing elements to melt the eutectic metal alloy when heat is applied from the heater.

21. The method of claim 13 wherein the catch comprises a fishing tool.

22. The method of claim 21 wherein the fishing tool comprises one or more of a grapple or slips.

23. The method of claim 13, wherein at least one of the one or more sealing elements made of rubber, non-rubber elastomer, or a non-eutectic metal or metal alloy is sacrificed during melting of the at least one or more melting metal sealing elements.

24. The method of claim 13 wherein the catch creates a mechanical joint that resists relative axial movement of the downhole tool with respect to the downhole tubular in at least one direction.

25. The method of claim 24 wherein the catch comprises one or more of a grapple and a slip.

* * * * *